US006730002B2

(12) United States Patent
Hald et al.

(10) Patent No.: US 6,730,002 B2
(45) Date of Patent: May 4, 2004

(54) INCLINING TREAD APPARATUS

(75) Inventors: Patrick Hald, Park City, UT (US); Gerald Nelson, Colorado Springs, CO (US)

(73) Assignee: Icon IP, Inc., Logan, UT (US)

( * ) Notice: Subject to any disclaimer, the term of this patent is extended or adjusted under 35 U.S.C. 154(b) by 90 days.

(21) Appl. No.: 09/967,870

(22) Filed: Sep. 28, 2001

(65) Prior Publication Data

US 2003/0064862 A1 Apr. 3, 2003

(51) Int. Cl.[7] ..... A63B 71/00
(52) U.S. Cl. ..... 482/51; 482/54
(58) Field of Search ..... 482/54, 51

(56) References Cited

U.S. PATENT DOCUMENTS

| | | | | |
|---|---|---|---|---|
| 3,602,502 A | | 8/1971 | Hampl | 272/69 |
| 4,151,988 A | | 5/1979 | Nabinger | 272/69 |
| 4,544,152 A | | 10/1985 | Taitel | 272/69 |
| 4,659,078 A | | 4/1987 | Blome | 272/128 |
| 4,687,195 A | | 8/1987 | Potts | 272/69 |
| 4,842,266 A | | 6/1989 | Sweeney, Sr. et al. | 272/69 |
| 4,848,737 A | | 7/1989 | Ehrenfield | 272/70 |
| 5,733,228 A | | 3/1998 | Stevens | 482/54 |
| 5,810,696 A | | 9/1998 | Webb | 482/52 |
| 5,833,577 A | * | 11/1998 | Hurt | 482/54 |
| 5,860,894 A | | 1/1999 | Dalebout et al. | 482/54 |
| 6,050,923 A | | 4/2000 | Yu | 482/54 |
| 6,110,076 A | | 8/2000 | Hurt | 482/54 |
| 6,231,482 B1 | | 5/2001 | Thompson | 482/27 |

* cited by examiner

*Primary Examiner*—Nicholas D. Lucchesi
*Assistant Examiner*—Tam Nguyen
(74) *Attorney, Agent, or Firm*—Workman Nydegger

(57) ABSTRACT

An improved lift apparatus for use in an exercise device having a support base and a moveable element is disclosed. The moveable element can be selectively raised and lowered relative to the support base by the user during operation of the exercise device. The improved lift apparatus includes: (i) a first lift motor; (ii) a second lift motor; and (iii) a synchronization mechanism for synchronizing the first and second lift motors. A belt safety mechanism for controlling unanticipated movement of the endless belt is also disclosed.

20 Claims, 10 Drawing Sheets

INCLINING TREAD APPARATUS

BACKGROUND OF THE INVENTION

1. The Field of the Invention

The present invention relates to the field of exercise equipment. More specifically, the present invention relates to exercise equipment having an inclining tread apparatus.

2. The Relevant Technology

The desire to improve health and advance cardiovascular efficiency has increased in recent years. This desire is coupled with the desire to exercise in locations that are within a limited space such as within an individual's home or an exercise gym. This trend has led to an increased desire for the production of exercise equipment.

For example, inclining apparatuses have become very popular. Walking or running on an inclined surface requires a user to raise the user's knees in continual, strenuous strides. This requires more exertion than walking or running on a flat surface. Consequently, exercising on an inclined surface can provide a more intense, challenging workout.

Inclining apparatuses come in a variety of types and configurations, such as treadmills and climbing apparatuses. The treadmill provides a flat endless moving assembly upon which the user can walk or run. Climbing apparatuses typically feature an endless moving assembly positioned at a significant angle and often allow significant lateral movement.

Inclining apparatuses often include a lift mechanism such as a motor or motor/lever assembly for inclining and declining the support frame. Lift motors used in these lift mechanisms often must be small and compact to accommodate the esthetic and space limitations inherent in the designs demanded by home and exercise gym consumers. The drawback of smaller more compact motors is that to provide the lifting force often demanded by such systems, the motors become impractically large or prohibitively expensive.

Increased lifting force is often required with the increased weight requirements of more robust inclining apparatuses. The stronger components of the inclining element of such apparatuses are also heavier than in the smaller units. More robust units are popular for commercial use, such as in exercise gyms, where repetitive use requires more sturdy construction. However, commercial use demands more lifting force than the affordable and more compact lifting motors can provide.

Another problem inherent in many inclining exercise apparatuses is the freewheeling of the endless belt. When the drive system is not engaged and a force is applied to the endless belt, in some motor configurations, the endless moving assembly moves freely in response to the force. Such arrangements can cause unexpected movement of the endless belt when a user inadvertently steps on the belt.

SUMMARY AND OBJECTS OF THE INVENTION

It is therefore an object of the invention to provide an improved exercise apparatus.

It is another object of the invention to provide a lifting apparatus for a moveable element that utilizes a plurality of lift motors to provide increased lifting force.

It is another object of the invention to provide a synchronization mechanism for minimizing variations in the operation of the first and second lift motors.

It is another object of the invention to provide a synchronization mechanism that is a mechanical mechanism for synchronizing operation of first and second lift motors.

It is another object of the invention to provide a synchronization mechanism that is a software or hardware implementation for synchronizing operation of first and second lift motors.

It is another object of the invention to provide a tolerance regulator mechanism for ensuring that operation of first and second lift motors does not exceed a predetermined variation.

It is another object of the invention to provide a synchronization mechanism that is a hybrid mechanical and software or hardware design for coordinating operation of first and second lift motors.

It is another object of the invention to provide a control module for monitoring operation of the first and second lift motors.

It is another object of the invention to provide a circuit switching mechanism for switching counter assignments where motor control assignments are switched.

It is another object of the invention to provide a belt safety mechanism to regulate unanticipated movement of the endless belt.

An inclining exercise apparatus of the present invention comprises a first and second lift motor and a synchronization mechanism. The first and second lift motors are coupled to a moveable element and to the synchronization mechanism. The synchronization mechanism is coupled to a support base of the exercise apparatus. In a neutral position, the moveable element is configured such that a support frame is substantially parallel to the support surface. The distal end of the support frame selectively inclines above the neutral position and selectively declines below the neutral position.

The inclining apparatus of the present invention benefits from increased lifting capacity due to the incorporation of a plurality of lift motors without sacrificing cost efficiency or compactness of the motors. An additional benefit of this system is that manufacturers of lift motors can utilize existing lift motor configurations of smaller exercise apparatuses without having to develop and manufacture special motors for heavier exercise apparatuses.

A challenge when using multiple motors is synchronizing operation of the motors. Where the lift motors exert slightly unequal forces or provide slightly unequal extension, normal operation of the exercise apparatus can easily be disturbed. These disruptions can render multiple lift motor configurations impracticable. To deal with these challenges, the exercise apparatus of the present invention utilizes a synchronization mechanism. The synchronization mechanism, in one embodiment, comprises a mechanical mechanism. The mechanical mechanism includes a sway bar, a cross support, and a pivot mechanism. The first lift motor is coupled to a sway bar first end. The second lift motor is coupled to a sway bar second end. The sway bar allows minor variations in the operation of the first and second lift motors to be minimized by pivoting of the sway bar.

The synchronization mechanism, in another embodiment, comprises a control module. The control module comprises a first sensor and a first counter; a second sensor and a second counter; and a logic element. The first sensor and first counter monitor operation of the first lift motor. The second sensor and second counter monitor operation of the second lift motor. The logic element utilizes the information from the first and second sensors and first and second counters to control operation of the first and second motors. In an alternative embodiment, the synchronization mechanism also comprises a combination of the recited mechanical mechanism and control module.

A tolerance regulator is provided in the present invention. The tolerance regulator comprises first and second contact switches. When the operation of first and second lift motors exceeds a given variation, the sway bar pivots about the pivot mechanism to the extent that the first or second contact switch is triggered by interaction with the cross support. The triggering of the contact switch discontinues normal operation of the first and second lift motors until variation is reduced and synchronization is restored.

A switching circuit is provided in the present invention. The switching circuit utilizes the first and second counters and the logic element to determine if the first motor is operating in response to commands sent to first motor or is operating in response to commands sent to second motor. Similarly, the switching circuit enables the second motor to determine if the second motor is operating in response to commands sent to the second motor or is operating in response to commands sent to the first motor. If it is determined that the motors are operating in response to commands sent to the other motor, the switching circuit switches counter assignment in the logic element. Switching counter assignment allows for proper operation of the control module in maintaining synchronization in the event that motors are receiving signals sent to one another.

Another feature of the exercise apparatus is a belt safety mechanism. The belt safety mechanism prevents unpredictable movement of the endless belt. The belt safety mechanism comprises a motion detector, a drive system, and a belt movement regulator. The motion detector monitors movement of the endless belt and whether the movement of the endless belt is in response to user input or is unanticipated. Where the movement is unanticipated, the belt movement regulator starts the drive system and consequently starts movement of endless belt for a preset interval at a predetermined slow speed. The belt safety mechanism additionally sends an audible and/or visual prompt to user to start exercising with appropriate input to exercise apparatus.

These and other objects and features of the present invention will become more fully apparent from the following description and appended claims, or may be learned by the practice of the invention as set forth hereinafter.

BRIEF DESCRIPTION OF THE DRAWINGS

In order that the manner in which the above recited and other advantages and features of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Figure 1:
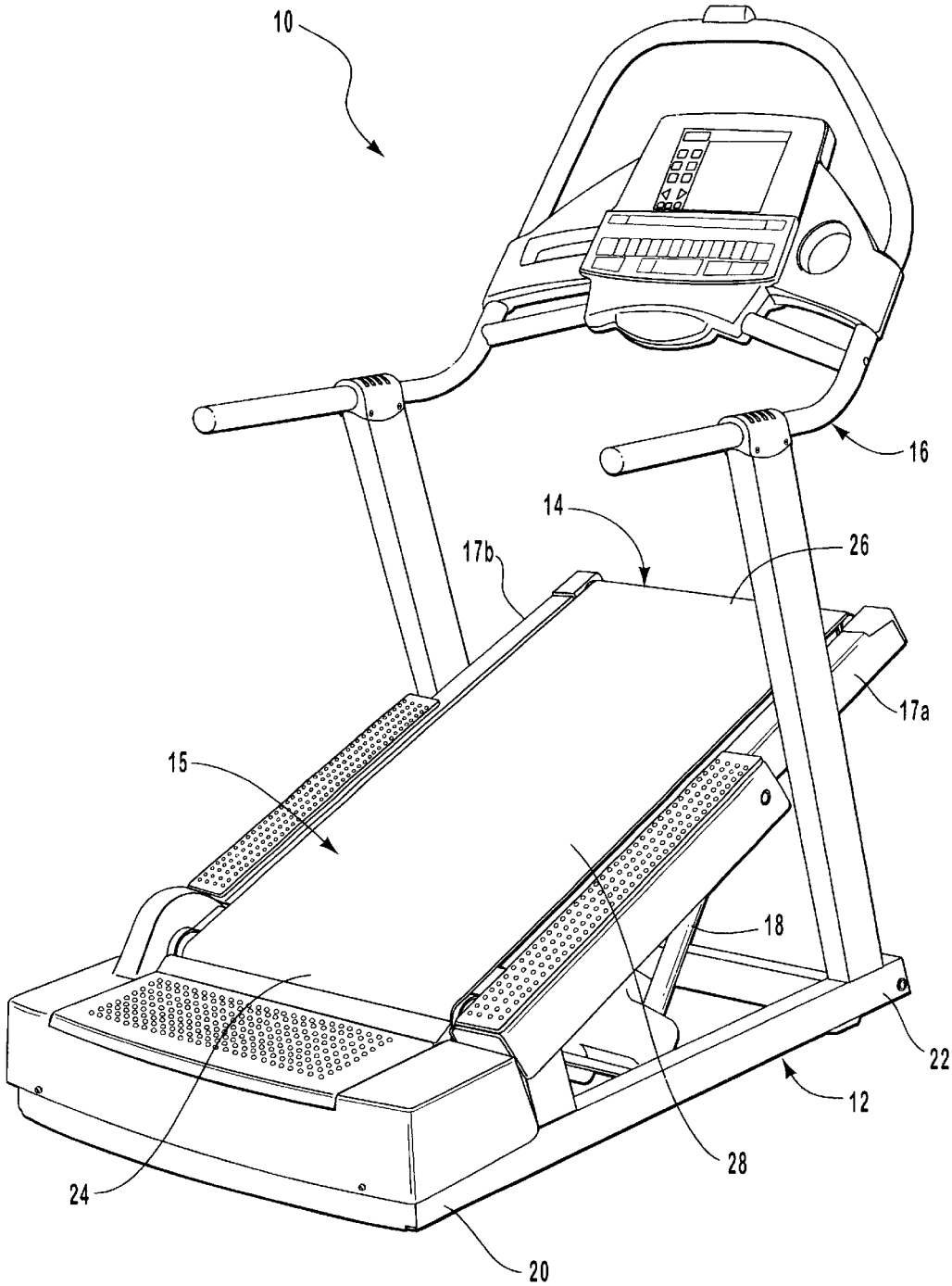
FIG. 1 is a perspective view of an exemplary exercise device in which the lift apparatus is used.

With reference now to FIG. 1, a selectively inclining and selectively declining exercise apparatus 10 is shown in which the present invention is employed. Exercise apparatus 10 supports a user ambulating thereon, such as in a hiking, running, or walking mode.

Exercise apparatus 10 comprises a support base 12 and a user support frame 14, upon which a user ambulates, movably coupled thereto. Support frame 14 comprises (i) first and second elongate frame rails 17*a*, 17*b*; (ii) first and second rollers 36*a* and 36*b* (FIG. 5) mounted on opposing ends of the first and second frame rails 17*a*, 17*b*; and (iii) an endless belt 15 trained about the rollers 36*a*, 36*b*. Support frame 14 has a proximal end 24, a distal end 26, and an inner portion 28 therebetween.

Support frame 14 is one example of a movable element. However, a variety of different moveable elements may be movably coupled to the base 12 or to a variety of other support bases. Thus, base 12 is depicted to show one embodiment of a support base and support frame 14 is depicted to show one embodiment of a movable element movably coupled thereto. However, a variety of different support bases and movable elements movably coupled thereto may be employed in the present invention, such as those disclosed in U.S. application Ser. No. 09/496,569, filed Feb. 2, 2000, entitled "Hiking Exercise Apparatus," which is incorporated herein in its entirety by reference, for example, and a variety of others.

Exercise apparatus 10 further comprises (i) a handrail assembly 16 coupled to the support base 12; and (ii) a lift apparatus 18. Support base 12 has a proximal end 20 and a distal end 22.

As depicted in FIG. 1, in an incline position, support frame 14 is capable of inclining to extreme angles such that the distal end 26 is high above the neutral position. The lift apparatus 18 of the present invention enables a user to incline support frame 14 to such angles.

Figure 2:
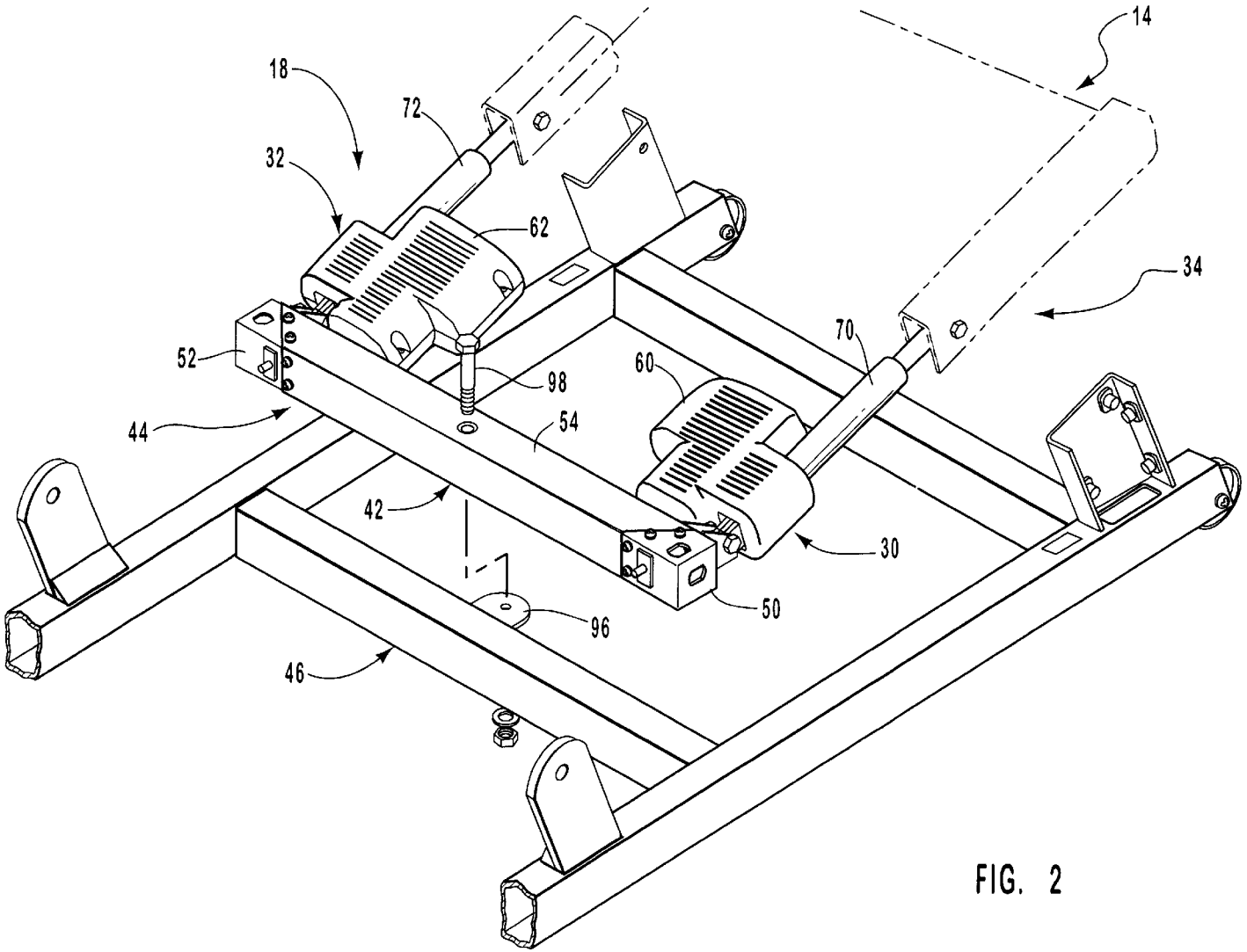
FIG. 2 illustrates the sway bar mechanism; illustrating the mechanical linkage and the first and second lift motors.

With reference now to FIG. 2, lift apparatus 18 of the present invention is shown. The lift apparatus 18 comprises a first lift motor 30, a second lift motor 32, and a synchronization mechanism 34 configured to synchronize the first and second lift motors 30, 32. The synchronization mechanism 34 may comprise a synchronization mechanism comprising mechanical components. Synchronization mechanism 34 may also comprise hardware such as an application specific integrated circuit or any other suitable hardware configuration. Synchronization mechanism 34 may also comprise software such as computer-executable instructions, associated data structures, program modules, and other routines, programs, objects, components, data structures, etc. that perform particular tasks or implement particular abstract data types. Synchronization mechanism 34 and the other synchronization mechanisms disclosed herein are examples of means for synchronizing the first and second lift motors 30, 32. Various examples of the synchronization mechanism 34 will be discussed in additional detail below.

In the illustrated embodiment synchronization mechanism 34 comprises a mechanical linkage 42 coupled to base 12. Mechanical linkage 42 comprises a sway bar 44 and a fixed cross support 46. Sway bar 44 comprises a sway bar first end 50, a sway bar center 54, and a sway bar second end 52. The first lift motor 30 is coupled to the sway bar first end 50 and the second lift motor is coupled to sway bar second end 52. First and second lift motors 30 and 32 are fixedly pivotally coupled to sway bar 44, as illustrated in FIG. 2. Lift motors 30 and 32 are comprised of driving elements, 60 and 62 respectively, and lift arms, 70 and 72 respectively. Driving elements 60 and 62 provide the electro-mechanical force necessary to extend lift arms 70 and 72. Extension of lift arms 70 and 72 provides the mechanical force necessary to lift the moveable element.

While other lift motor systems also allow a user to incline support frame of an exercise apparatus, the lift apparatus of the present invention utilizes first and second lift motors 30 and 32 are alternatively fixedly coupled to sway bar 44.

Lift motors 30 and 32 are comprised of driving elements, 60 and 62 respectively, and lift arms, 70 and 72 respectively. Driving elements 60 and 62 provide the electro-mechanical force necessary to extend lift arms 70 and 72. Extension of lift arms 70 and 72 provides the mechanical force necessary to lift movable support frame 14, or optionally another embodiment of a moveable element.

While other lift motor systems also allow a user to incline support frame of an exercise apparatus, the lift apparatus of the present invention benefits from utilizing two synchronized lift motors. The use of two synchronized lift motors enables lift motor system of the present invention to lift heavier loads than could be lifted by a comparable single lift motor. Additionally, because the first and second lift motors 30 and 32 are synchronized, complications from minor variations in the operation of the motors, such as twisting of movable support frame 14 are prevented.

Figure 3:
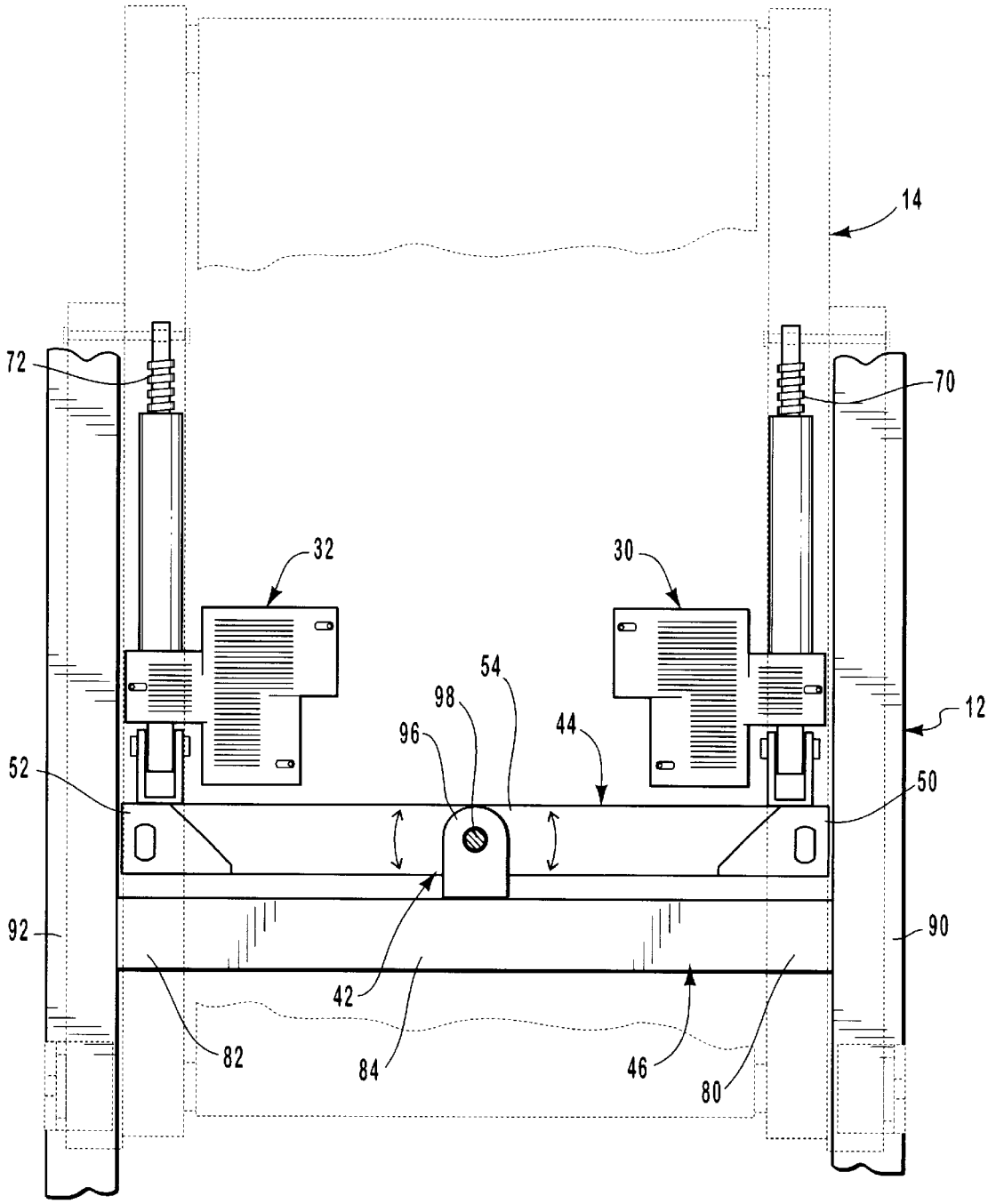
FIG. 3 illustrates the sway bar mechanism pivotally coupled to the support base.

With reference now to FIG. 3, there is shown mechanical linkage 42 coupled to support base 12. Cross support 46 of mechanical linkage 42 comprises a cross support first end 80, a cross support center 84, and a cross support second end 82. Cross support first end 80 is coupled to a first lateral side 90 of support base 12. Cross support second end 82 is coupled to second lateral side 92 of support base 12. Cross support center 84 is coupled to sway bar 44. In alternative embodiment, mechanical linkage 42 is coupled to movable frame 14 and first and second lift motors 30 and 32 are coupled to support base 12.

As shown in FIG. 3, sway bar center 54 is pivotally coupled to cross support center 84. In the preferred embodiment, cross support center 84 further comprises a sway bar brace 96 that extends distally toward sway bar 44 from cross support 46. Sway bar brace 96 provides adequate displacement between sway bar 44 and cross support 46 to allow sway bar 44 to pivot about the axis of a pivot mechanism 98, such as a pin, a bolt, or any other mechanism that allows sway bar 44 to pivot with respect to cross support 46 or any other mechanism allowing sway bar 44 to pivot about the axis of cross support center 84.

Extension of lift arm 70 of first lift motor 30 exerts a force against sway bar first end 50. In the absence of an equal and offsetting force from the extension of lift arm 72 of second lift motor 32, the sway bar 44 will rotate about the axis of pivoting mechanism 98, the sway bar first end 50 rotating in the direction of cross support first end 80. Alternatively extension of the lift arm 72 of second lift motor 32 exerts a force on sway bar second end 52. If not offset by an equal and offsetting force from extension of lift arm 70, the sway bar 44 will rotate about the axis of pivoting mechanism 98, the sway bar second end 52 rotating in the direction of cross support second end 82. Thus, mechanical linkage 42, and more particularly the sway bar 44 component of the mechanical linkage 42, is able to offset minor variations in the operation of first lift motor 30 and second lift motor 32 by compensating for unequal forces applied by the lift motors. By synchronizing operation of motors 30 and 32, mechanical linkage 42 allows a substantially equal force to be exerted on the opposing sides of moveable support frame 14 (see FIG. 2) by lift arms 70 and 72.

Figure 4:
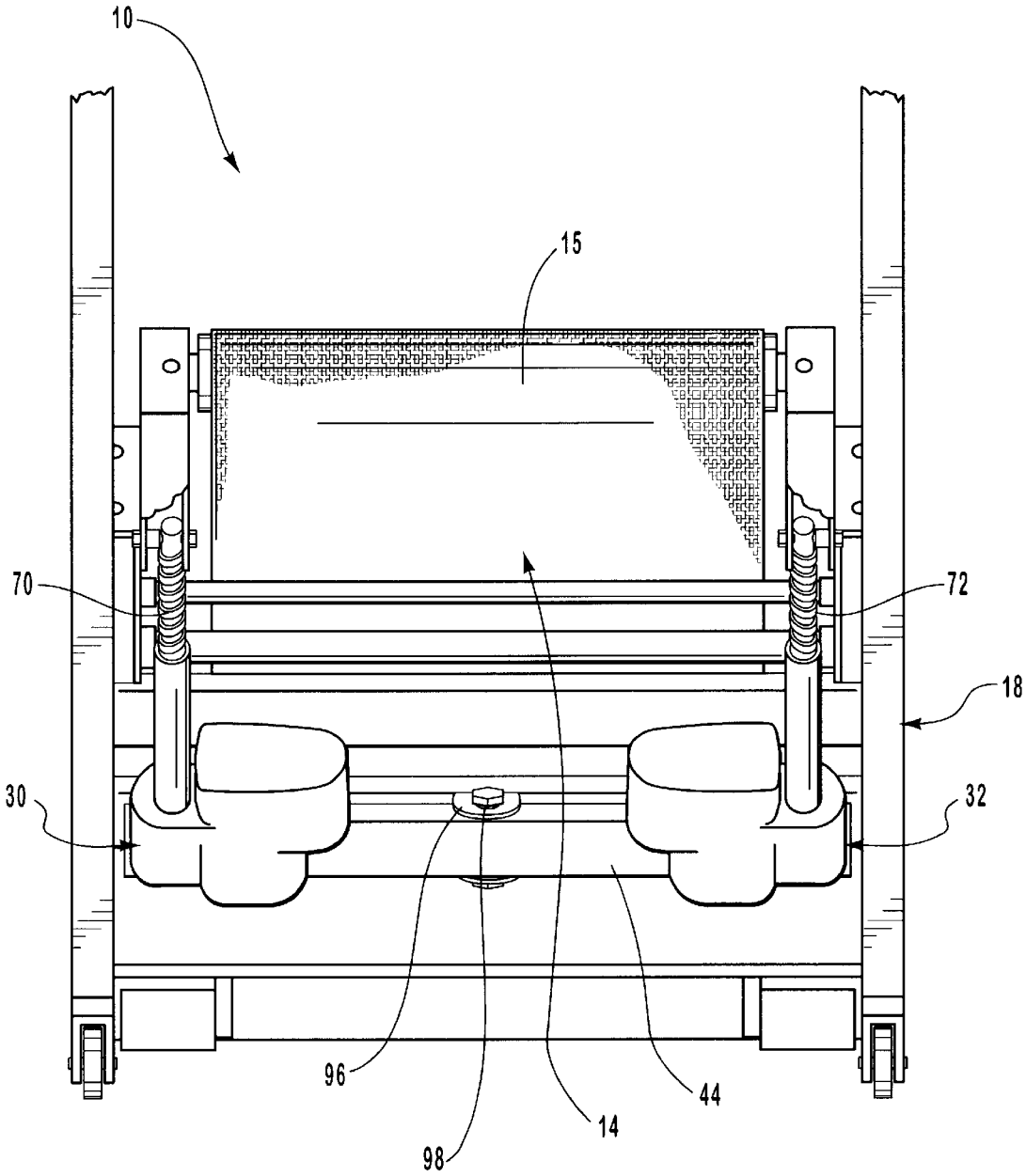
FIG. 4 is a front cut-away view of the lift apparatus in an exercise device in an inclined position.
Figure 5:
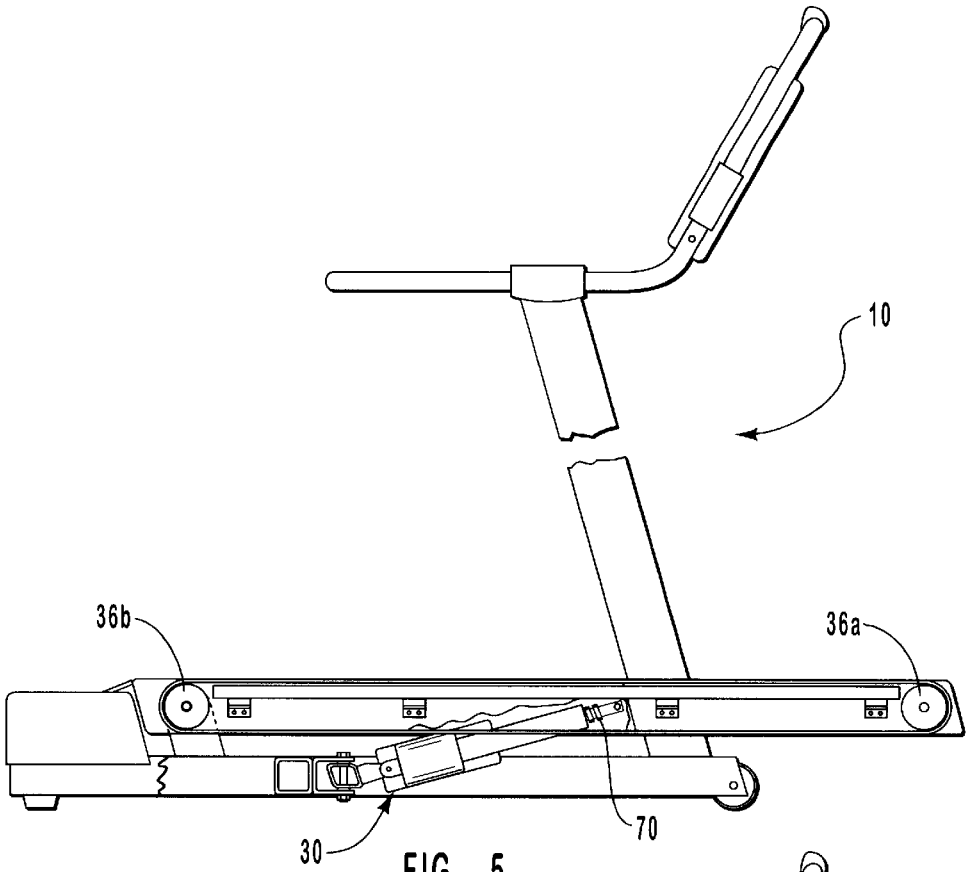
FIG. 5 is a perspective view of the lift apparatus in an exercise device in a neutral position.
Figure 6:
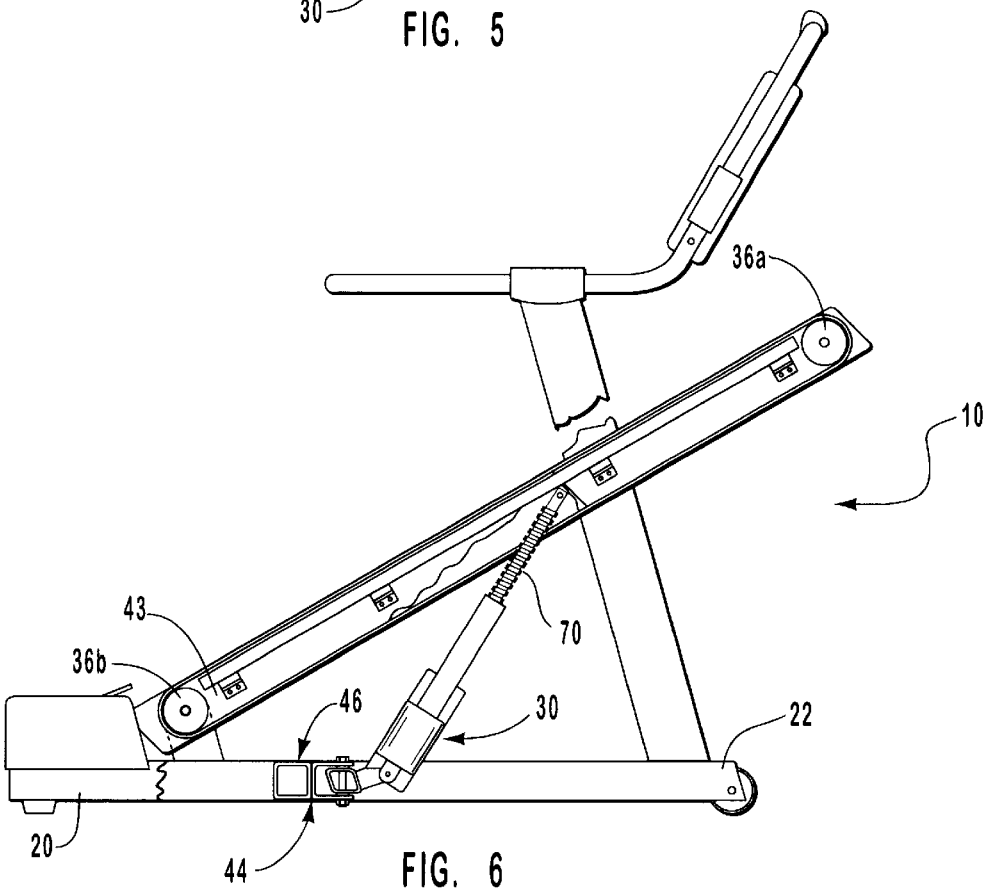
FIG. 6 is a perspective view of the lift apparatus in an exercise device in the inclined position.

With reference now to FIGS. 4–6, the selectively inclining and selectively declining exercise apparatus 10 is further shown. These figures illustrate lift apparatus 18 in additional detail. As depicted in FIG. 4, lift arms 70 and 72 of respective first lift motor 30 and second lift motor 32 are coupled to movable support frame 14. Movable support frame 14 is movably coupled to base 12. In the preferred embodiment, coupling between moveable support frame 14 and lift motors 30 and 32 is pivotal. This allows for changes in the angle between support frame 14 and support base 12.

FIG. 5 illustrates exercise apparatus 10 with support frame 14 in a neutral position. In the neutral position, first and second lift arms 70 and 72 of first and second lift motors 30 and 32 are in a retracted position.

FIG. 6 illustrates exercise apparatus 10 with support frame 14 in an inclined position. In the inclined position, the lift arms 70 and 72 of the first and second lift motors 30 and 32 are in an extended position. The mechanical linkage 42 ensures that a synchronized force is exerted on support frame 14 from lift arms 70 and 72.

In the preferred embodiment, cross support 46 is coupled to first and second lateral sides 90 and 92 of support base 12 near the proximal end 20 of support base 12. In this embodiment, the lift arms 70 and 72 of first and second lift motors 30 and 32 are coupled distally therefrom.

In an alternative embodiment the cross support 46 is coupled to first and second lateral sides 90 and 92 of support base 12 near the distal end 22 of support base 12. In this embodiment, the lift arms 70 and 72 of first and second lift motors 30 and 32 are coupled toward the proximal end 43 of movable support frame 14.

In another embodiment, the lift arms 70 and 72, of the first and second lift motors 30 and 32 are indirectly coupled to the support frame 14 or other moveable element, such as by being coupled to lever arms that are coupled to the support frame 14. The lever arms are coupled to the support base 12 and the movable support frame 14. The movement of the lift arms 30 and 32 exerts a force on lever arms necessary to raise and lower the moveable element.

In yet another embodiment, first and second lift motors 30 and 32 are coupled to a telescoping handrail assembly. The telescoping handrail assembly is coupled to movable support frame 14. This causes movable support frame 14 and support frame 14 to raise and lower with the corresponding movement of the handrail assembly 16.

These embodiments are merely illustrative, and should not be considered to limit the scope of the present invention. It will be understood by those skilled in the art, that a variety of coupling configurations allowing synchronization of a plurality of lift motors may be utilized without departing from the scope of the present invention.

Figure 7:
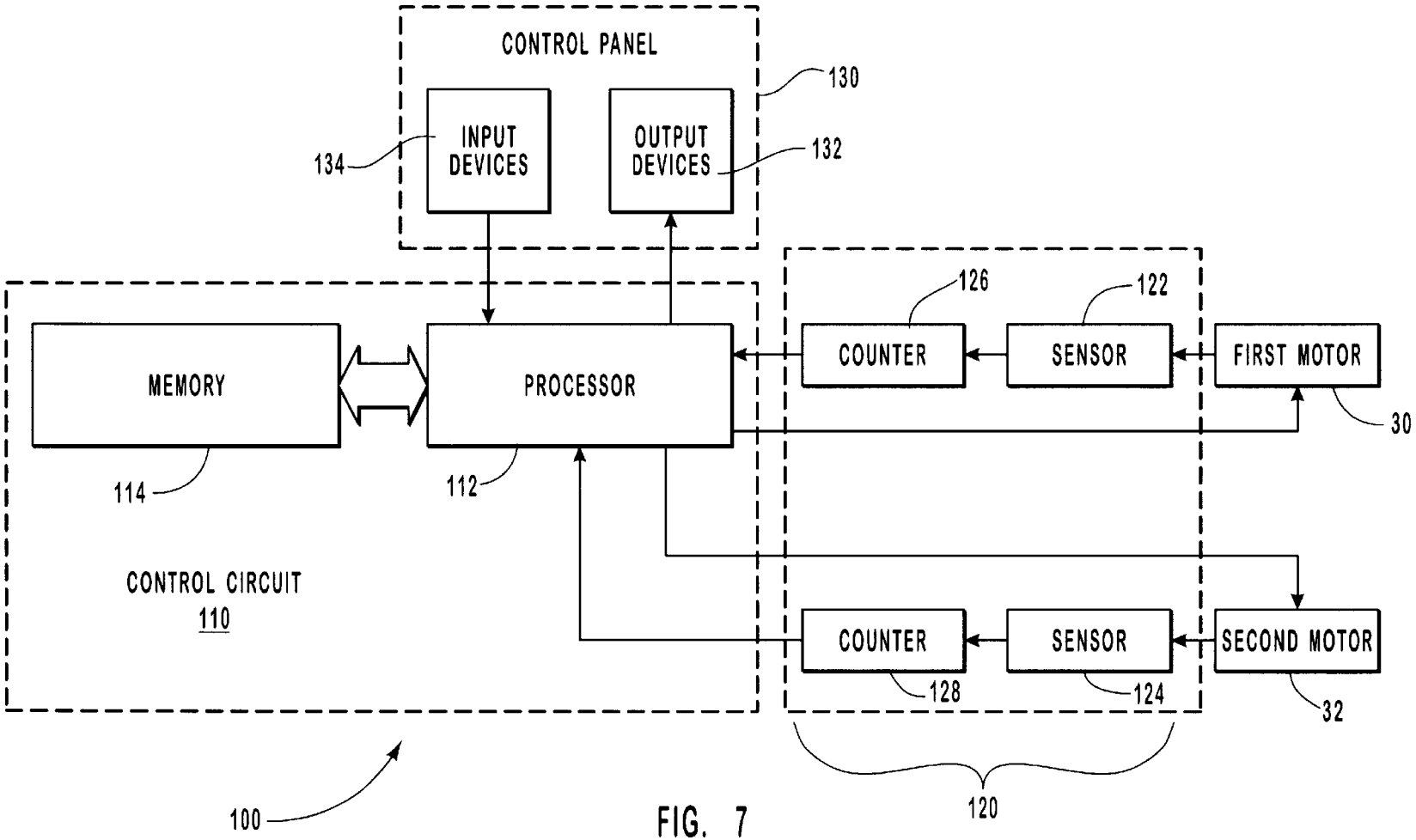
FIG. 7 is functional block diagram of the present invention illustrating the monitoring system for maintaining the first and second motors in a predefined rotational parameter.

With reference now to FIG. 7, there is depicted via block diagrams another embodiment of a synchronization mechanism configured to synchronize first and second lift motors 30 and 32 is shown. The synchronization mechanism of FIG. 7 comprises a control module 100. Control module 100 may be employed in combination with, or independently from the mechanical synchronization mechanism 34 discussed above.

In this embodiment, control module 100 maintains first and second lift motors 30 and 32 in a predefined rotational parameter, as discussed below.

Control module 100 comprises a control circuit 110, a counter system 120, and a control panel 130. The control circuit 110 may comprise hardware such as a processor and memory, an application specific integrated circuit, and/or any other suitable hardware configuration. Alternatively the control circuit 110 may comprise software such as computer-executable instructions, associated data structures, program modules, and/or other routines, programs, objects, components, or data structures, etc. that perform particular tasks or implement particular abstract data types. Control circuit 110 is one example of a logic means for automatically controlling operation of the first and second lift motors such that the difference between the first and second counters does not exceed a predefined value.

The control circuit 110 controls operation of the first and second lift motors. The control circuit 110 ensures that the difference between the first and second counters does not exceed a predefined value by sending messages to the first and second lift motors 30 and 32 and receiving feedback from the counter system 120. The control circuit 110 also sends output to the control panel 130 and receives input from user via the control panel 130. The control circuit comprises a processor 112 and a memory system 114. The processor produces output to the counter system 120, the control panel 130, and to the first and second lift motors 30 and 32.

The input from the control panel may comprise a variety of data including: (i) user instructions; (ii) system functioning information; and/or lift commands to the lift motors. The processor 112 receives feedback from the counter system 120 and the control panel 130. The memory system 114 records data received from the processor 112 as well as information necessary for running the processor 112. Information for running the processor 112 includes commands, algorithms, and/or other data. Such information may be embedded in an electronic chip, software, database, or any other memory system as is known to those skilled in the art. Processor 112 conveys data to memory system 114. Memory system 114 provides information to processor 112 necessary for functioning of the processor 112.

Control panel 130 comprises output devices 132 for relaying information to the user and input devices 134 for allowing the user to input commands to control module 100. This allows the control circuit 110 to request user input and allows the user to input commands for operation of the lift motors and other systems of the exercise device 10.

Counter system 120 comprises a first and second sensor 122 and 124 and a first and second counter 126 and 128. Sensors monitor operation of first and second lift arms 70 and 72, thus monitoring operation of first and second lift motors 30 and 32. First and second counters 126 and 128 tabulate increments detected by first and second sensor 122 and 124 from first and second lift motor 30 and 32.

In response to user input from input devices 134, processor 112 sends commands to first and/or second lift motors 30 and 32 to lift or retract. First and second sensors 122 and 124 monitor when lift arms 70 and 72 rotate through a predefined rotational angle.

When first and second lift arms 70 and 72 rotate through a predefined rotational angle in a first direction, first and second counters 126 and 128 record an increment. When first and second lift arms 70 and 72 rotate through a predefined rotational angle in a second direction, first and second counters 126 and 128 record a decrement. With each increment or decrement, as recorded by first and second counters 126 and 128, corresponding data representing counter change is sent to processor 112 for processing.

Figure 8:
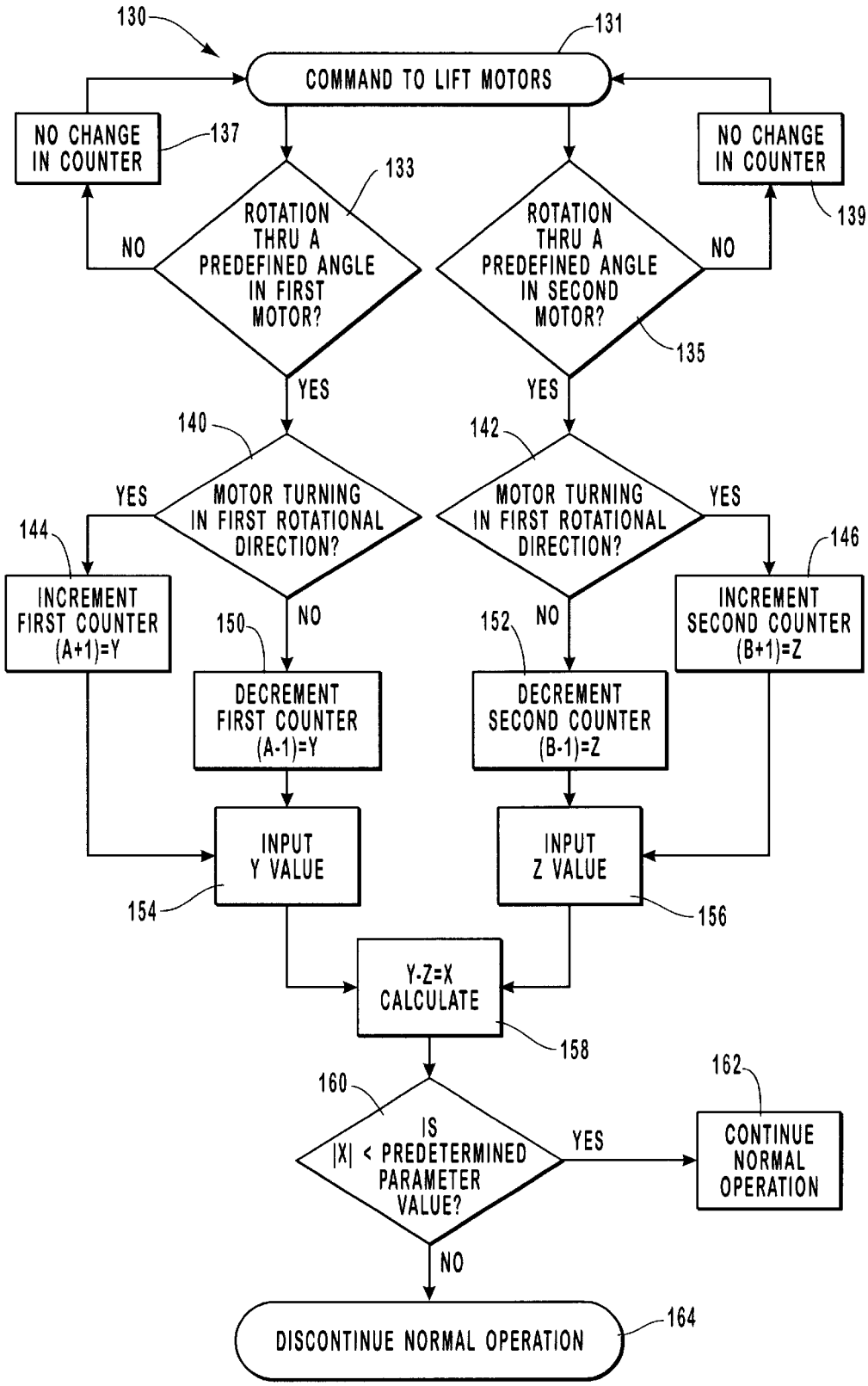
FIG. 8 is a flow chart illustrating the logic of the control module counter system.

With reference now to FIG. 8, a flowchart demonstrating operation of control module 100 for synchronizing first and second lift motors 30 and 32 is shown. As disclosed, one method of the present invention comprises a step of detecting a command to lift motors 131. Upon detecting a command sent to lift motors, the determination of whether there has been rotation through a predefined rotational angle in the first motor 133 is made. Where there has been no rotation through a predefined rotational angle in the first motor, the step of not changing first counter 137 is executed. Where there has been rotation through a predefined angle in the first motor, the step of determining whether motor is turning in the first rotational direction 140 is executed.

Where the motor has turned in the first rotational direction, the step of incrementing first counter 144, as is represented by the equation (A+1)=Y, is executed. Where the first motor has turned, but not in a first rotational direction, the step of decrementing counter 150, as represented by the equation (A−1)=Y, is executed.

Using the new counter value as represented by Y in both increment step 144 or decrement step 150, the step of inputting the Y value 154 is then executed, the Y value representing the current counter tally in the first counter.

Upon detecting a command sent to lift motors (see step 131) and at the same time the determination of rotation through a predefined angle in first motor (see step 133) is made, another determination of whether there has been rotation through a predefined angle in the second motor is also executed at step 135. In the absence of rotation through a predefined angle in the second motor, the step of not changing second counter 139 is executed. If there has been rotation through a predefined angle in the second motor, the determination of whether the second motor is turning in a first rotational direction is executed (see step 142).

If the second motor has turned in a first rotational direction, then the step of incrementing second counter 146, as represented by the equation (B+1)=Z, is executed. Where the second motor has turned, but not in a first rotational direction, the step of decrementing the second counter 152, as represented by the equation (B−1)=Z, is executed. Using the new counter value, as represented by Z in both increment step 146 and decrement step 152, the step of inputting the Z value 156 is executed, the Z value representing the current counter tally in second counter.

Using the Y value from step 154 and the Z value from step 156, the step of calculating an X value 158 is executed using the equation of Y−Z=X, wherein X is an absolute value.

Using the X value from step 158, a determination of whether X is less than a predetermined parameter value is made at step 160. Where X is less than a predetermined parameter value, the step of continuing normal operation 162 of lift apparatus 18 is executed. Where X is greater that the predetermined parameter value, the step of discontinuing the normal operation 164 of lift apparatus 18 is executed.

Thus, as demonstrated by FIGS. 7–8, control module 100 synchronizes operation of first and second lift motors 30, 32 by ensuring that variation in the operation of first and second lift motors 30, 32 does not exceed a predetermined parameter value. The predetermined parameter value represents a degree of variation between operation of first and second lift motors 30 and 32 that could cause problems with the normal operations of the exercise system 10. Such problems could include twisting of the support frame 14 or interference with the normal operation of the endless belt 15.

In the event that variation between first and second lift motors 30 and 32 does exceed the predetermined parameter value, the step of discontinuing normal operation 164 is conducted. This step of discontinuing normal operation 164 can include such acts as simply shutting down lift motors 30 and 32. It can also include a more complicated process of temporarily shutting down lift motors 30 and 32 and engaging in a troubleshooting process in an attempt to correct variation and bring X within the predetermined parameter value. In one embodiment, control module will correct variations in operations of lift motors when such variations are less than would cause problems with normal operation of exercise apparatus. For example, control module may engage in corrective processes any time variation is one half of the variation normally associated with problematic operation.

Figure 9:
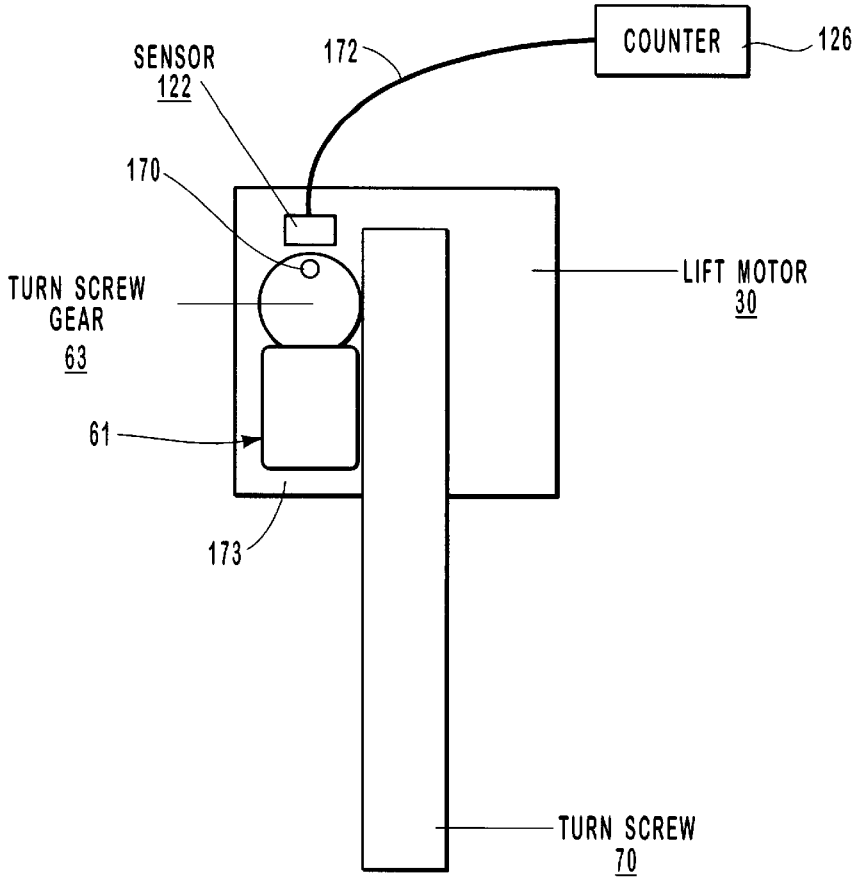
FIG. 9 is a depiction of a lift motor assembly and counter system.
Figure 10:
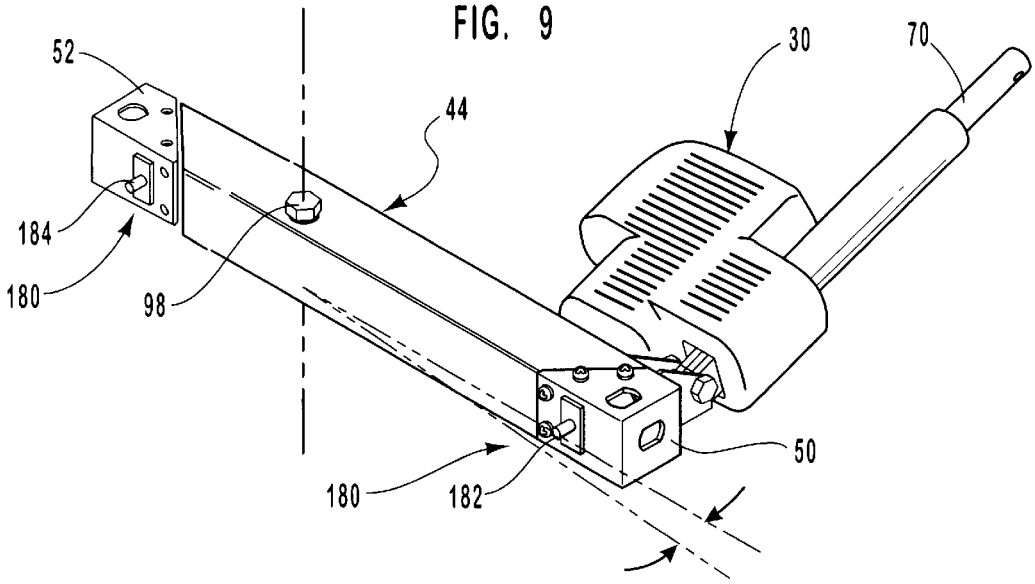
FIG. 10 is a schematic view of a tolerance regulator illustrating first and second contact switches.

Referring now to FIG. 9, there is shown an embodiment of counter system 120. For the sake of illustration, first lift motor 30 and the manner in which counter system 120 monitors the extension and retraction of the lift arm 70 of first lift motor 30 is shown. As demonstrated in FIG. 7, the counter system also monitors the extension and retraction of lift arm 72 of second lift motor 32. Counter system 120, by monitoring the operation of both first and second lift motors 30, 32 allows control module 100 to synchronize operation of first and second lift motors 30, 32. Due to the substantial similarity in the functioning of counter system 120 in first and second lift motors 30, 32, in the current embodiment, illustration of the manner in which counter system 120 monitors first lift motors 30 is sufficient.

With reference now to FIGS. 7–9, counter system 120 comprises sensor 122 and counter 126. FIG. 9 represents a depiction of first lift motor 30, first sensor 122, and first counter 126. In one embodiment, second lift motor 32, second sensor 124, and second counter 128 are comprised in the same or similar manner.

In one present embodiment, sensor 122 is integrally coupled to first lift motor 30. Sensor 122 is coupled to counter 126 via a signal transducting mechanism 172. In one preferred embodiment, signal transducting mechanism 172 comprises an electric wire but alternatively may comprise a wireless signal mechanism, a mechanical mechanism, or any of a plurality of other known signal mechanisms, for example, as will be recognized by those skilled in the art.

In the embodiment of FIG. 9, first lift motor 30 comprises a lead screw drive mechanism 61, a lead screw gear 63, lead screw 70, and a lift motor housing 173. Upon receiving a command from processor 112, lead screw drive mechanism 61 begins rotating lead screw gear 63, which in turn rotates lead screw 70. Upon receiving a command to raise moveable support frame 14, lead screw gear 63 rotates in a first direction extending lead screw 70. In response from a command from processor 112 to lower movable support frame 14, lead screw gear 63 rotates in a second direction recessing lead screw 70.

In one embodiment, sensor 122 comprises a magnetic sensor. In this embodiment, sensor 122 is configured to detect a magnetic marker 170 coupled to the lead screw gear 63. A given rotational angle of lead screw gear 63 represents a given displacement of lead screw 70. Sensor 122 recognizes rotation of lead screw 70 through a predefined rotational angle by detection of the magnetic marker 170. Detection of magnetic marker 170 in combination with data representing rotational direction of lead screw 70 enables counter 126 to increment or decrement in correspondence with whether lead screw 70 is extending or recessing. The number of magnetic markers 170 may be selected according to a predetermined parameter.

With continued reference to FIGS. 7–9, the counter system provides valuable data to the control module. For example, if 180 degree rotation of lead screws 70, 72 represents the displacement amount that is monitored by the control module, and one complete rotation of lead screw gear 63 turns lead screw 180 degrees, a single magnetic marker 170 can be used. Consequently, sensors 122, 124 will recognize each 180 degree rotation of the respective lead screws 70, 72. In this embodiment, each increment and decrement represents a 180 degree rotational angle and the corresponding displacement of lead screws 70, 72. According to this embodiment, the predetermined parameter value representing the variation of first and second lift motors 30, 32 is based on increments, each of which represent a 180 degree rotation of lead screws 70, 72. A representative parameter value (see step 160 of FIG. 8) may be two (2) increments. Using this representative parameter value of X=2, each time the rotation of lead screws 70, 72 of first and second lift motors 30, 32 differ more than one full rotation (i.e., more than 360 degrees), the control module will discontinue normal operation of the first and second lift motors 30, 32 (see step 164 of FIG. 8).

As will be recognized by those skilled-in-the-art, FIG. 9 represents one illustrated embodiment of the manner in which counter sensor system 120 monitors lift motors 30, 32. Other embodiments of counter system 120 may include other sensor configurations such as optical, mechanical or any of a plurality of sensors. For example, a sensor circuit may electrically monitor functioning of lift motor 31 and calculate the corresponding displacement of lead screw 71. Placement of magnetic marker 170 and the corresponding configuration of sensors 124, 126 may also vary. One or more magnetic makers 170 may be embedded on the lead screw or the drive mechanism. Additionally, other embodiments of lift motors 30, 32 may include other cam mechanisms such as hydraulic or electrical cams that could be used in place of lead screw lift motors.

The synchronization mechanisms described with reference to FIGS. 7–9 are additional examples of means for synchronizing the first and second lift motors. These mechanisms may be employed in conjunction with or independently from the mechanical synchronization mechanism discussed with reference to FIGS. 2–6.

To act as a fail safe for the synchronization mechanisms of FIGS. 1–6 and/or FIGS. 7–9, the exercise apparatus of the present invention may further comprise a tolerance regulator 180. Tolerance regulator 180 maintains variations between first and second lift motors 30 and 32 within a predetermined parameter. Tolerance regulator 180 comprises a first contact switch 182 and a second contact switch 184. Tolerance regulator 180 operates by discontinuing normal operation of lift motors 30 and 32 in the event that first contact switch 182 or second contact switch 184 is triggered. In one embodiment, first contact switch 182 is coupled to the first end of a sway bar 50. The second contact switch 184 is coupled to the second end of a sway bar 52. It will be appreciated by those skilled in the art in light of this disclosure that a variety of detection mechanisms beside a contact switch could be placed in a variety of configurations without departing from the spirit of the invention.

In the event that the extension of the lift arms 70 and 72 begins to vary, the sway bar 44 will rotate about the axis of the pivot mechanism 98. The sway bar first end 50 or sway bar second end 52 will be forced in the direction of cross support 46. In the event that variation in the operation of first and second lift arms 70 and 72 exceeds the predefined parameter, sway bar first end 50 or sway bar second end 52 will be moved close enough to cross support 46 to trigger first contact switch 182 or second contact switch 184. In one embodiment, triggering the first or second contact switch discontinues operation of lift motors 30, 32. In another embodiment, triggering of one of the contact switches causes the lift motors to be corrected, e.g., by causing the control module 100 to enter a trouble shooting mode.

Thus, the tolerance regulator 180 can function as a backup safety mechanism in the event that control module 100 fails to properly synchronize operation of first and second lift motors 30 and 32. Minor variations in operation of first and second lift motors 30 and 32, which do not exceed the predetermined parameter, can continue to be offset by pivoting of sway bar 44 without triggering contact switches 182 and 184. Thus, the system allows for normal operation of first and second lift motors 30 and 32 in the event that the variation does not exceed the predetermined parameter.

Figure 11:
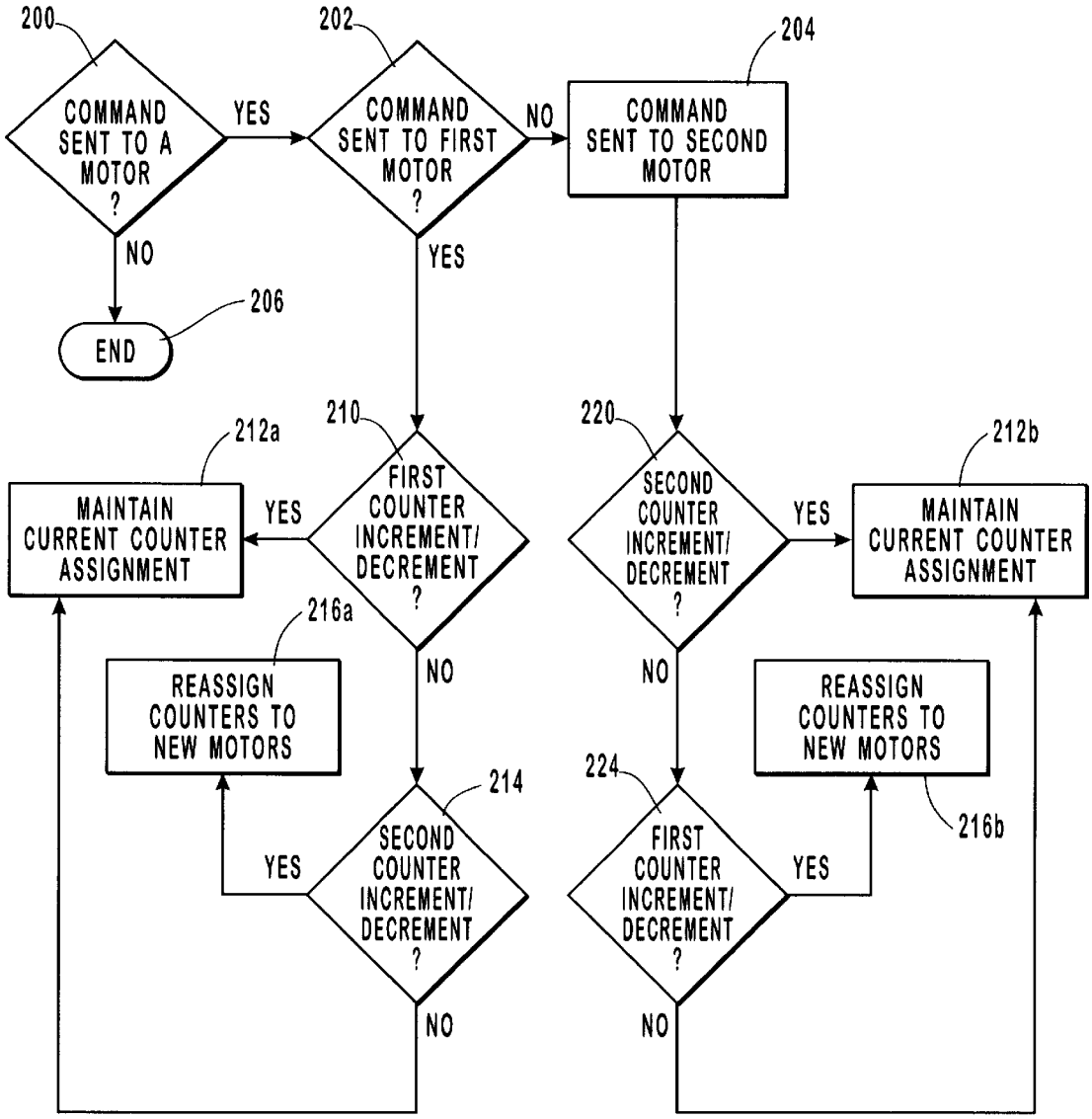
FIG. 11 is a flow chart illustrating the logic of the mechanism for swapping assignment of first and second counters.

With reference now to FIG. 11, another mechanism that may be employed in the present invention is a switching circuit. The switching circuit may be useful in the event that: (i) wires for the lift motors are inadvertently switched (e.g., during repair); or (ii) in the event that commands designed to be delegated to a first motor are actually performed by a second motor.

FIG. 11 shows a flowchart demonstrating the logic of a switching circuit for swapping assignment of first and second counters 126 and 128. In this method, a determination of whether a command has been sent to a lift motor 200 is made. In the event it is determined that no command has been sent to a motor, the step of ending execution 206 is conducted. If a command has been sent to a lift motor, a determination of whether command has been sent to first motor 202 is made. In the event that it is determined that a command has been sent to first motor, a determination of whether the first counter is incremented or decremented 210 is conducted. In the event that the first counter has incremented or decremented, the step of maintaining the current counter assignment 212*a* is executed. Where the first counter has not incremented or decremented, a determination of whether the second counter has incremented or decremented 214 is made. In the event that it is determined that second counter has incremented or decremented, the step of reassigning counters to new motors 216*a* is executed. Where it is determined that the second counter has not incremented or decremented, the step of maintaining current counter assignment 212*a* is conducted.

Where it is determined that a command has been sent to a motor and that the command was not sent to the first motor, switching circuit executes the step of assuming that the command was sent to second motor 204. Where it is assumed that the command was sent to second motor, a determination of whether second counter has been incremented or decremented 220 is conducted. If it is determined that second counter has been incremented decremented, the step of maintaining current counter assignment 212*b* is executed. In the event that it is determined that second counter has not incremented or decremented, the determination of whether the first counter has incremented or decremented 224 is conducted. Where the first counter has incremented or decremented, switching circuit executes the step of reassigning counters to new motors 216*b*, i.e., counter 126 is reassigned to second motor 32 and counter 128 is reassigned to first motor 30 (see FIG. 7). Where the first counter has not incremented or decremented, the step of maintaining current counter assignment 212*b* is conducted by the switching circuit.

The switching circuit of FIG. 11 enables system to determine whether second motor 32 is operating in response to commands sent to first motor 30 or is operating in response to commands sent to second motor 32, and vice versa. Switching of commands may occur in response to a faulty system repair where wires were improperly attached to the wrong motors. It may also occur due to a mistake within the implementation of the software or control circuit. The switching circuit may be a useful tool in maintaining synchronization of first and second motors 30 and 32. By correcting the assignment of first and second counters 126 and 128, commands temporarily sent to the wrong motors can be reassigned thus eliminating a possible cause of variation between the first and second motors 30 and 32. Furthermore correcting assignment of first and second counters allows control module 100 to operate properly.

The exercise apparatus 10 may be further comprised of a variety of different mechanisms that assist in various manners in the operation of the exercise apparatus 10. For example, it may be useful to employ a belt safety mechanism to prevent inadvertent and unexpected movement of the endless belt, such as when a user steps on the belt without intending to move the belt.

Figure 12:
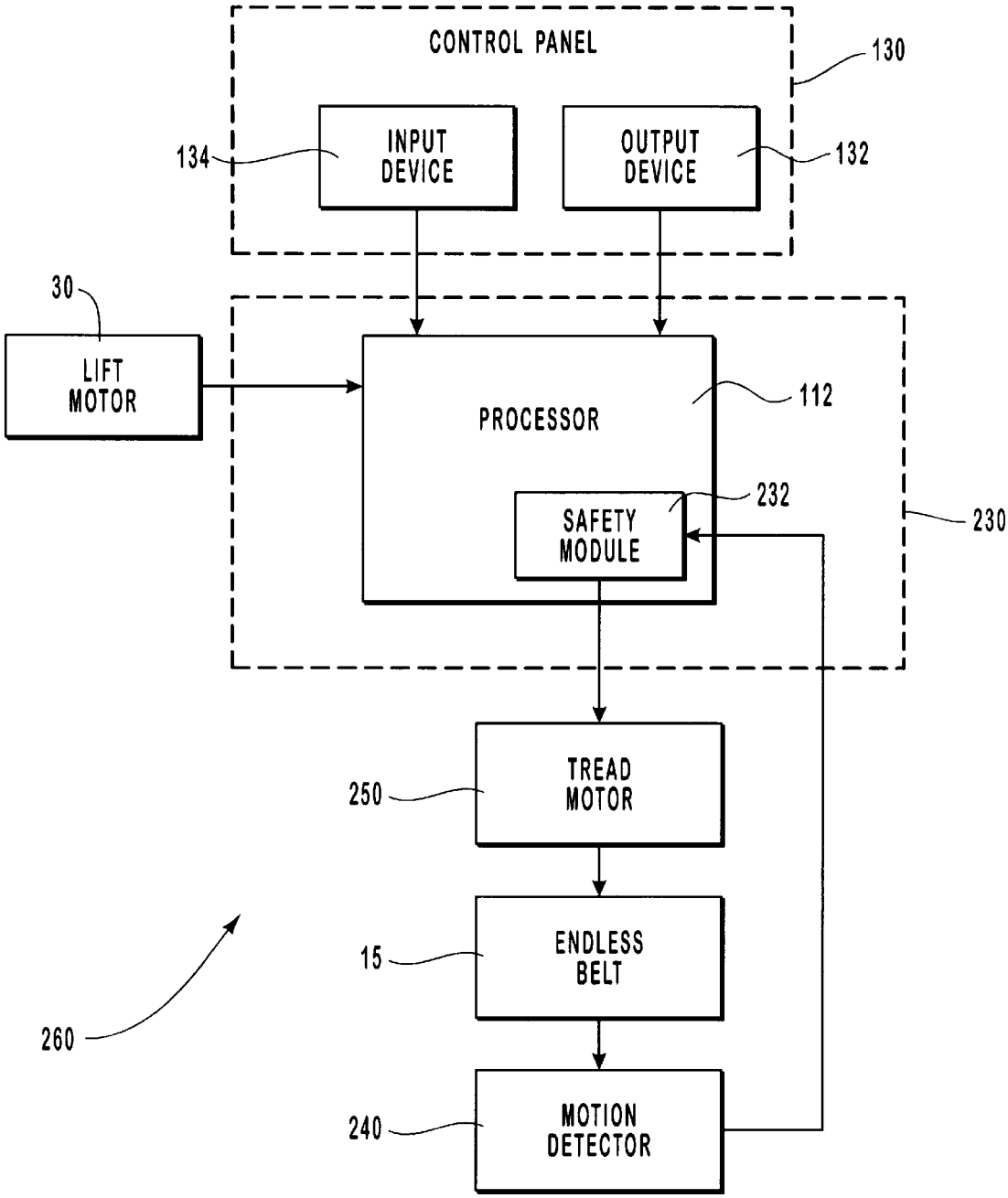
FIG. 12 is a block diagram of the belt safety mechanism illustrating the belt movement regulator, the motion detector, and the safety module.

With reference now to FIG. 12, there is shown a block diagram of a belt safety mechanism 260 for use in exercise device 10. Belt safety mechanism 260 comprises a belt movement regulator 230 and a motion detector 240. Belt movement regulator 230 may comprise hardware such as processor and memory, an application specific integrated circuit, and/or any other suitable hardware configuration. Alternatively the belt movement regulator 230 may comprise software such as computer-executable instructions, associated data structures, program modules, and/or other routines, programs, objects, components, data structures, etc. that perform particular tasks or implement particular abstract data types. Belt movement regulator 230 is one example of a means for regulating movement of the endless belt.

As is illustrated in FIG. 12, there is also shown a lift motor 30 (one or more lift motors may be employed), an endless belt 15, belt230comprises a processor 112 and a safety module 232. The safety module 232 is coupled to processor 112. The processor 112 executes logic commands to prevent unanticipated movement of endless belt 15. The safety module 232 sends a message prompt to user in response to engagement of endless belt 15. As will be understood by those skilled-in-the-art, safety module 232 may merely be coupled to the processor 112 and operate independently of processor. Alternatively, safety module 232 may be integrated in the pra drive system 250 (comprising, e.g., a tread motor that turns a roller about which the endless belt is trained), and a control panel 130 of the exercise device 10. In the preferred embodiment, the belt movement regulator 230 comprises a processor 112 and a safety module 232. The safety module 232 is coupled to processor 112.

The processor 112 executes logic commands to prevent unanticipated movement of endless belt 15. Unanticipated movement of the endless belt may occur, for example, movement of the endless belt without turning the exercise apparatus on. This may occur, for example, when a user steps on a treadmill belt without turning the treadmill on, such as when the user: (i) is walking from one end of a room to another and steps on the treadmill belt or (ii) attempts to ambulate (e.g., walk, hike, or run) on the treadmill belt without proper input into the control panel. The belt may move if the motor has no inherent braking power and the motor "freewheels", allowing the belt to move. Unanticipated movement of the endless belt may also occur while the exercise machine is turned on, but the tread motor is not instructed to drive the belt.

Such unanticipated movements are examples of movement of the endless belt that results from a force independent from the drive system 250. Belt movement regulator 230 is one example of a means for regulating movement of the endless belt when movement of the endless belt is unanticipated.

Motion detector 240 is configured such that it detects motion of the endless belt 15. Motion detector 240 may detect motion of endless belt 15 by directly detecting motion of endless belt 15. Alternatively, motion detector 240 detects motion of the endless belt indirectly by detecting motion of the drive system 250 (e.g., by detecting movement of the tread motor). Because the drive system (e.g., comprising the tread motor) 250 is coupled to the endless belt 15, when the endless belt is moved by a force independent of the drive system, such as a user stepping on the treadmill belt, the drive system will also move 250.

Upon detecting motion of endless belt 15, motion detector 240 sends a signal to processor 112 indicating the movement of endless belt 15. The processor 112 then determines whether motion of endless belt 15 was anticipated. Movement of the endless belt is considered to be anticipated when the processor 112 has received input from user input device 134 to actuate drive system 250, causing belt 15 to move.

To determine whether movement of endless belt 15 was anticipated, the processor 112 monitors the presence or absence of input data from the control panel 130. In the absence of input commands from the control panel 130 directing the belt 15 to move, the processor 112 assumes that any endless belt 15 movement is unanticipated, such as discussed above. As mentioned above, such unanticipated movements are examples of movement of the endless belt that results from a force independent from the drive system 250.

The processor monitors whether the drive system 250 is actuated, i.e., whether the drive system 250 is moving the belt 15. Where the drive system 250 is not actuated, but movement of the endless belt is detected, the processor 112 assumes the movement of the endless belt 15 was in response to a force independent of the drive system 250, such as a force on the belt resulting from a user ambulating thereon when the drive system is not actuated. Alternatively, a force independent of the drive system could result from a user inadvertently making contact with the endless belt 15. These are also examples of unanticipated movements of the endless belt.

If the processor 112 determines that the motion of the endless belt was anticipated, i.e., the result of the drive system 250 being actuated, a means for allowing normal functioning (not shown) of the drive system will allow the drive system 250 to operate normally. Means for allowing normal functioning of the drive system may comprise any software or hardware configuration which allows the system to operate normally in the event that movement of the drive system is anticipated.

If it is determined that the motion was unanticipated, movement regulator 230 sends a command to actuate the drive system 250 in order to begin movement of the endless belt 15. To actuate the drive system 250, means for actuating endless belt 15 is employed. Means for actuating endless belt 15 could comprise any hardware or software configuration which is able to turn on the drive system.

In the event the movement regulator 230 actuates drive system 250 in response to movement of the endless belt, safety module 232 sends a message prompt to the user. The message prompt may indicate to the user that the endless belt 15 is being moved by the drive system 250 and/or may indicate to the user the need to enter the proper input to move the belt. Safety module 232 may be coupled to the processor 112 and operate independently of processor. Alternatively, safety module 232 may be integrated in the processor 112 as an integrated circuit or software.

In one embodiment of the present invention, upon actuation by motion regulator 230 in response to unanticipated movement, drive system 250 moves the belt a predetermined slow speed for a preset interval. After the preset interval, the processor 112 can then disengage the drive system 250.

In one embodiment, the belt safety mechanism 260 waits for a preset interval of drive system disengagement before monitoring the movement of endless belt 15. The preset interval of drive system disengagement allows endless belt 15 to stop moving when there is no force independent from the drive system moving the belt. However, in one embodiment, where such an independent force is still being applied to the belt after the period of disengagement and in response to continued unanticipated movement of the endless belt 15, the belt safety mechanism 260 actuates the drive system 250 for another preset interval. In another embodiment, belt safety mechanism 260 allows user override the disengagement with appropriate input into control panel 130.

When motion regulator 230 actuates drive system 250, safety module 232 sends a message prompt to an output device 132 of the control panel 130. The message prompt may be an audible prompt, a visual prompt, or a combination of the two. The message prompt may instruct the user to start movement of the endless belt 15, for example. Thus, in the event that user has attempted to begin exercising without the proper input to input device 134 of the control panel 130, the belt safety mechanism 260 will engage the endless belt 15 at a predetermined slow speed and encourage user to start the endless belt 15 with appropriate input into input device 134. In addition, in the event that the endless belt moves from a force other than the result of an attempt to begin the use of the exercise device, moving the endless belt 15 at a predetermined slow speed will prevent unexpected and unpredictable freewheeling motion of the endless belt 15 that could result in harm to the user.

The motion detector 240 may be a magnetic sensor, for example. However, as will be appreciated by those skilled in the art, the motion detector 240 may comprise a variety of different motion detecting mechanisms, including but not limited to, a mechanical, electrical, and/or optical sensor.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An improved lift apparatus for use in an exercise device having a support base and a moveable element, wherein the moveable element can be selectively raised and lowered relative to the support base by the user during operation of the exercise device, and wherein each of the support base and the moveable element have opposing first and second sides, the improved lift apparatus comprising:

a first lift motor coupled between the support base and the moveable element;

a second lift motor coupled between the support base and the moveable element; and means for synchronizing the first and second lift motors, wherein the means for synchronizing comprises a sway bar, the sway bar having a longitudinal axis, wherein the sway bar pivots about an axis other than said longitudinal axis.

2. An improved lift apparatus as recited in claim 1, wherein the means for synchronizing comprises:

a cross support rigidly connected to the first and second sides of the support base;

and wherein the sway bar has a first end, a center, and a second end, wherein the sway bar is pivotally coupled to the cross support, and wherein the first lift motor is coupled to the first end of the sway bar and the second lift motor is coupled to the second end of the sway bar, such that the sway bar compensates for variation between the first and second lift motors.

3. An improved lift apparatus as recited in claim 1, wherein the means for synchronizing comprising:

a cross support rigidly connected to the first and second sides of the support base;

wherein the sway bar has a first end, a center, and a second end, wherein the sway bar is pivotally coupled to the cross support, and wherein the first lift motor is coupled to the first end of the sway bar and the second lift motor is coupled to the second end of the sway bar, such that the sway bar compensates for variation between: (i) the displacement of the first motor; and (ii) the displacement of the second motor.

4. An improved lift apparatus as recited in claim 1, wherein the means for synchronizing comprises:

a cross support rigidly connected to, and extending between, the first and second sides of the support base and having a first end, a center, and a second end;

wherein the sway bar has a first end, a center, and a second end, wherein the sway bar is pivotally coupled to the cross support, and wherein the first lift motor is coupled to the first end of the sway bar and the second lift motor is coupled to the second end of the sway bar, such that the sway bar compensates for relatively minor variations in the operation of the first and second lift motors.

5. An improved lift apparatus as recited in claim 1, wherein the first and second lift motors are pivotally coupled to the movable element.

6. An improved lift apparatus as recited in claim 1, further comprising a tolerance regulator.

7. An improved lift apparatus as recited in claim 6, wherein the tolerance regulator comprises first and second contact switches, wherein an end of the sway bar will trigger one of the first or second contact switches in the event that the variation in operation of the first and second lift motors exceeds a given rotation parameter.

8. An improved lift apparatus as recited in claim 7, wherein the tolerance regulator disengages the first and second lift motors upon triggering one of the first or second contact switches.

9. An improved lift apparatus as recited in claim 1, wherein the means for synchronizing the first and second lift motors further comprises a control module for monitoring the first and second lift motors and maintaining the first and second lift motors within a predefined parameter relative to one another.

10. An improved lift apparatus as recited in claim 1, wherein the first and second lift motors comprise lead-screw type lift motors.

11. An improved lift apparatus as recited in claim 10, wherein the means for synchronizing the first and second lift motors further comprises a control module for monitoring the rotation of the first and second lift motors and maintaining the first and second lift motors within a predefined rotational parameter relative to one another.

12. An improved lift apparatus for use in an exercise device having a support base and a movable element, wherein the movable element can be selectively raised and lowered relative to the support base by the user during operation of the exercise device, wherein each of the support base and the moveable element have opposing first and second sides, the improved lift apparatus comprising:

a first lift motor coupled between the support base and the moveable element; a second lift motor coupled between the support base and the moveable element wherein the first and second lift motors comprise lead-screw type lift motors; and means for synchronizing the first and second motors, wherein the synchronizing means comprises a control module for monitoring the rotation of the first and second lift motors and maintaining the first and second lift motors within a predefined rotational parameter relative to one another; and wherein the control module comprises:

a first sensor and a first counter associated with the first lift motor, wherein the first sensor detects rotation of the first lift motor, increments the first counter each time the first lift motor rotates through a predefined rotational angle in a first rotational direction, and decrements the first counter each time the first lift motor rotates through a predefined rotational angle in a second rotational direction;

a second sensor and a second counter associated with the second lift motor, wherein the second sensor detects rotation of the second lift motor, increments the second counter each time the second lift motor rotates through a predefined rotational angle in the first rotational direction, and decrements the second counter each time the second lift motor rotates through a predefined rotational angle in the second rotational direction; and logic means, coupled to the first and second counters and to the first and second lift motors, for automatically controlling the operation of the first and second lift motors such that the difference between the first and second counters does not exceed a predefined value.

13. An improved lift apparatus for use in an exercise device having a support base and a movable element, wherein the movable element can be selectively raised and lowered relative to the support base by the user during operation of the exercise device, wherein each of the support base and the moveable element have opposing first and second sides, the improved lift apparatus comprising:

first lift motor coupled between the support base and the movable element; a second lift motor coupled between the support base and the moveable element; wherein the first and second lift motors comprise lead-screw type lift motors; and means for synchronizing the first and second motors, wherein the synchronizing means comprises a control module for monitoring the rotation of the first and second lift motors and maintaining the first and second lift motors within a predefined rotational parameter relative to one another; and wherein the control module comprises:

a first sensor and a first counter associated with the first lift motor, wherein the first sensor detects rotation of the first lift motor, increments the first counter each time the first lift motor rotates through a predefined rotational angle in a first rotational direction, and decrements the first counter each time the first lift motor rotates through a predefined rotational angle in a second rotational direction;

a second sensor and a second counter associated with the second lift motor, wherein the second sensor detects rotation of the second lift motor, increments the second counter each time the second lift motor rotates through a predefined rotational angle in the first rotational direction, and decrements the second counter each time the second lift motor rotates through a predefined rotational angle in the second rotational direction; and a control circuit, coupled to the first and second counters and to the first and second lift motors, for automatically controlling the operation of the first and second lift motors such that the difference between the first and second counters does not exceed a predefined value.

14. An improved lift apparatus as recited in claim 12, further comprising magnetic markers coupled at one or more positions on the lead screw gear of the first and second lift motors, wherein the positions represent a predefined rotational angle wherein the first and second sensors detect the one or more magnetic marker and the first and second counters increment or decrement based on the rotational direction of the motors.

15. An improved lift apparatus as recited in claim 14, wherein the predefined rotational angle comprises an angle of 180 degrees.

16. An improved lift apparatus as recited in claim 15, wherein the control module disengages the first and second lift motors when the variation between the first and second counters exceeds two increments.

17. An improved lift apparatus as recited in claim 12, wherein the logic means for controlling the operation of the first and second lift motors further comprises a switching circuit for switching assignment of the first and second counters; wherein the logic means upon recognizing the performance of a command delegated to the first motor by the second motor, switches assignment of the first and second counters.

18. An improved lift apparatus for use in an exercise device having a support base and a moveable element, wherein the moveable element can be selectively raised and lowered relative to the support base by the user during operation of the exercise device, and wherein each of the support base and the moveable element has opposing first and second sides, the improved lift apparatus comprising:

a first lift motor coupled between the support base and the moveable element;

a second lift motor coupled between the support base and the moveable element; and a synchronization mechanism configured to synchronize the first and second lift motors, the synchronization mechanism comprising a sway bar, the sway bar having a longitudinal axis, wherein the sway bar pivots about an axis other than said longitudinal axis.

19. An improved lift apparatus as recited in claim 18, wherein the synchronization mechanism further comprises a control module for monitoring the first and second lift motors and maintaining the first and second lift motors within a predefined parameter relative to one another and wherein the sway bar is coupled to each of the first and second lift motors.

20. An improved lift apparatus for use in an exercise device having a support base and a moveable element, wherein the moveable element can be selectively raised and lowered relative to the support base by the user during operation of the exercise device, and wherein each of the support base and the moveable element has opposing first and second sides, the improved lift apparatus comprising:

a first lift motor coupled between the support base and the moveable element proximate the first side;

a second lift motor coupled between the support base and the moveable element proximate the second side; and a mechanical linkage, interposed between the first and second lift motors and the support base, that compensates for variation between the first and second lift motors, wherein the mechanical linkage comprises a sway bar pivotally coupled to each of the first and second lift motors; and a control module for monitoring the first and second lift motors and maintaining the first and second lift motors within a predefined parameter relative to one another, the sway bar having a longitudinal axis, wherein the sway bar pivots about an axis other than said longitudinal axis.

* * * * *

UNITED STATES PATENT AND TRADEMARK OFFICE

CERTIFICATE OF CORRECTION

PATENT NO. : 6,730,002 B2
DATED : May 4, 2004
INVENTOR(S) : Patrick Hald and Gerald Nelson It is certified that error appears in the above-identified patent and that said Letters Patent is hereby corrected as shown below:

Column 7,
Lines 2 and 3, before “to raise” remove “and support frame 14”
Line 14, after “32” remove “is shown”

Column 12,
Line 59, before “230” insert -- --
Line 59, after “230” insert -- --

Column 15,
Line 31, before “wherein” remove “and”
Line 32, before “wherein” insert -- and --
Line 40, after “synchronizing” change “comprising” to -- comprises --

Column 16,
Line 35, before “wherein” insert -- ; --

Signed and Sealed this

Fourth Day of January, 2005

JON W. DUDAS
*Director of the United States Patent and Trademark Office*